United States Patent [19]

Corbett

[11] Patent Number: 4,509,653

[45] Date of Patent: Apr. 9, 1985

[54] FOOD CONTAINER

[76] Inventor: Warren J. Corbett, 2719 120th Avenue NE., Bellevue, Wash. 98005

[21] Appl. No.: 602,135

[22] Filed: Apr. 19, 1984

[51] Int. Cl.[3] ..... B65D 47/32

[52] U.S. Cl. ..... 215/231; 426/124

[58] Field of Search ..... 215/231, 228, 308, 311; 426/124, 112; 55/385 R, 385 C

[56] References Cited

U.S. PATENT DOCUMENTS 2,091,212 8/1937 McNeil ..... 215/231

*Primary Examiner*—Donald F. Norton

*Attorney, Agent, or Firm*—Fraser, Barker, Purdue & Clemens

[57] ABSTRACT

A container for packaging popping corn kernels under pressure in a bottle simulating that traditionally used for champagne and other sparkling wines wherein a valve is disposed between the bottom of a stopper and the upper level of the popcorn kernels for preventing the popcorn kernels from being expelled from the bottle upon removal of the stopper.

3 Claims, 3 Drawing Figures

FOOD CONTAINER

This invention related to containers for packaging granular products, and more particularly to containers for packaging granular products under pressure, together with means for preventing the granular product from being expelled from the container by the pressure when the container is opened.

BACKGROUND OF THE INVENTION

Packaging of premium quality food products is a paramount concern of fine food producers in attracting and enticing consumers to try such products. Accordingly, it is desirable to use fanciful styles of containers for packaging fine food products to attract and entice the consumer. For example, the packaging of a premium quality hybrid popping corn in a bottle of the type traditionally used for champagne and other sparkling wines to attract consumers. Further, labels of a similar style, as well as the stopper, wire cage and foil neck capsule are used to denote a gourmet product. Also, to entice a consumer, a method of pressurizing bottle has been developed using an inert gas to product a "pop" sound as associated with the opening of a bottle of champagne wine. However, when a bottle containing kernels of popcorn under pressure is opened a quantity of the popcorn kernels are also expelled from the bottle. This problem is critical to the overall appeal and uniqueness of the packaged product since the amount of pressure required to provide a respectable and audible "pop" is sufficient to expel as much as ½ cup of corn kernels with enough force and dispersion to create a mess and cause an unfavorable reaction to the package product which would result in a lasting negative impression upon the consumer.

SUMMARY OF THE INVENTION

Briefly, the container for packaging granular articles such as popcorn kernels constructed in accordance with the invention overcomes the aforementioned problem by providing an accordion valve which is disposed in the neck of a bottle between the granular product and the stopper which prevents the granular articles from being expelled from the bottle when the contents are packaged under pressure and subsequently opened.

It is an object of the invention to produce a pressurized container which will allow the release of a gas pressure sufficient to cause an audible "pop" while preventing solid granular contents from being expelled from the container.

BRIEF DESCRIPTION OF THE DRAWINGS

The above, as well as other objects of the invention will become readily apparent to one skilled in the art from reading the following detailed description of the preferred embodiment considered in light of the accompanying drawings in which.

DETAILED DESCRIPTION OF THE PREFERRED EMBODIMENT

Figure 1:
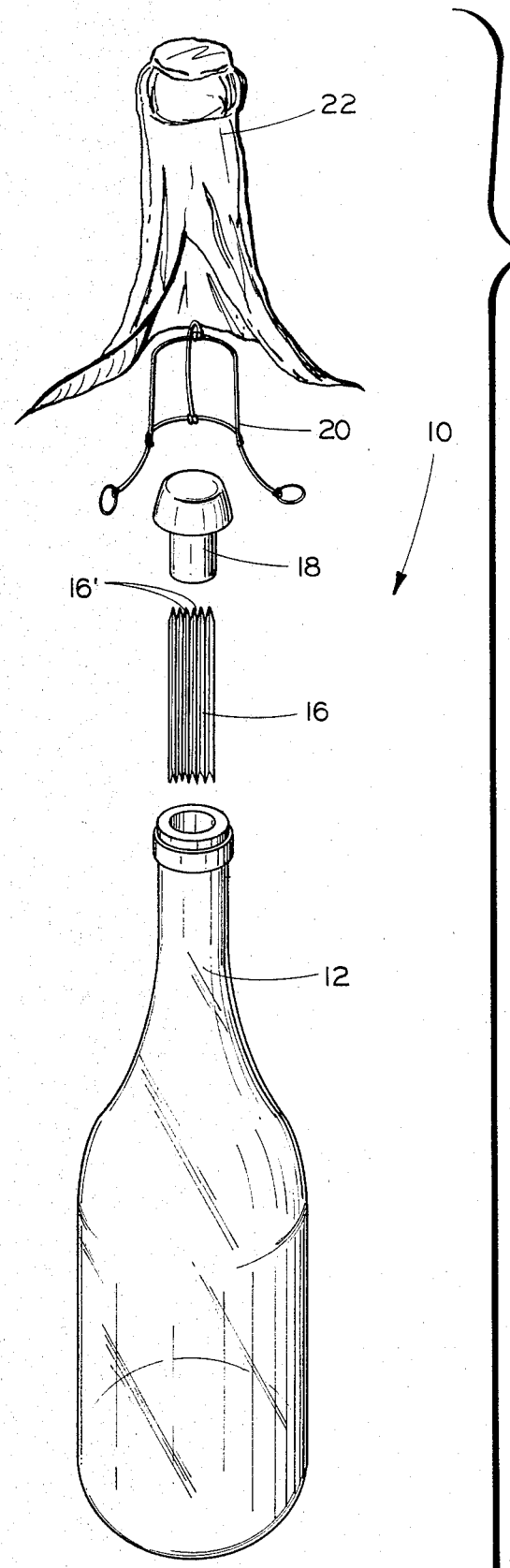
FIG. 1 is an exploded perspective view of a container constructed in accordance with the invention.
Figure 2:
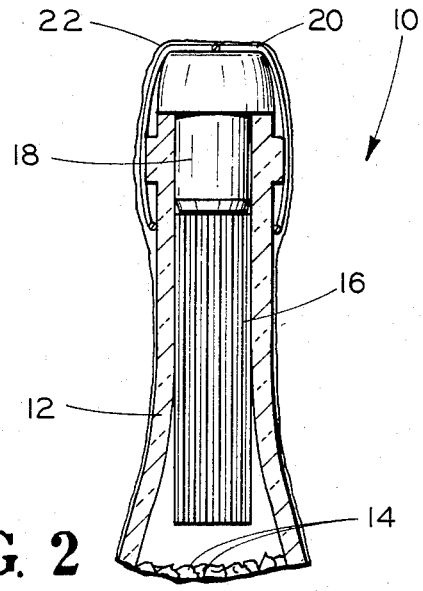
FIG. 2 is an enlarged fragmentary view of the neck of a sealed bottle illustrating the position of the accordion valve employed in this invention.

Referring now to the drawings where like reference numberals designate similar parts throughout, there is illustrated a container 10 comprising a bottle 12 containing a quantity of popcorn kernels 14, an accordion-fold valve 16 disposed above the popcorn kernels 14, a stopper 18 for closing the bottle 12, a wire cage 20 for securing the stopper 18 to the neck of the bottle 12 when the interior of the bottle 12 is pressurized with an inert gas, and a foil outer wrap 22.

It will be understood that the bottle 12 may be typically formed of glass, plastic, or other material which is physically and chemically capable of storing granular food products under pressure.

The primary function of the accordion-fold-valve 16 is to allow the release of a gas pressure which is sufficient to cause an audible "pop" sound similar to the "pop" sound that occurs during the opening of a bottle of sparkling wine, such as champagne-type wine, for example, while at the same time the solid granular contents such as popcorn kernels from being expelled from the bottle.

The size of the accordion-fold valve 16 is determined by the diameter of the neck opening of the bottle 12 and the space between the uppermost level of the popcorn kernels 14 and the top of the bottle 12, which is typically of the order of two (2) inches. The valve 16 may be typically formed of a bond paper, number 20 weight, of a width of eight and one-half (8½) inches and a height of the order of two (2) inches. The pleats 16 are formed by folding the paper one-half (½) inch alternating folds as accordion pleats 16, and thence compressing the valve 16 to a compressed state which is one-half (½)inch wide and two (2) inches high by three-sixteenth (3/16) inch thick. The folded valve element 16 is then easily inserted into the neck of the bottle 12 after the bottle 12 has been filled with a quantity of popping corn kernels 14. After insertion into the neck of the bottle 12, the valve 16 will expand to approximately two (2) inches when released thereby substantially transversing the neck of the bottle 12.

Figure 3:
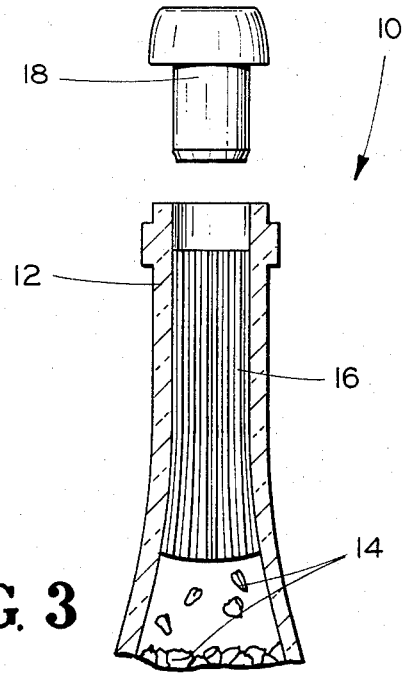
FIG. 3 is an enlarged fragmentary view of a neck of an open bottle illustrating the operative position of the accordion valve employed in the invention.

In operation, as the stopper 18 is twisted or "rocked" to and fro out of the neck of the bottle 12, the friction between the neck of the bottle 12 and the stopper 18 is decreased as the bearing surfaces diminish. At a point, the gas pressure inside the bottle 12 overcomes the friction and forces the stopper 18 out of the neck of the bottle, an audible "pop" sound will occur. As the gas rushes through the valve 16, the accordion pleats 16 expand forming a wedge shape (see FIG. 3) which fills, in corporation with corn kernels 14 (forced by the escaping gas) and jams, the neck of the bottle 12, thus permitting the gas to escape while functioning to contain the corn kernels 14 within the interior of the bottle 12.

It should be noted that in the absence of the valve 16 up to one-half cup of corn kernels 14 may be expelled in a manner quite like, if not identical to, a shot gun shell only at a much lower velocity.

In accordance with the provisions of the patent statutes, the principle and mode of operation of the invention has been explained and what is considered to represent its preferred embodiment has been illustrated and described. It should, however, be understood that the invention may be practiced otherwise and as specifically illustrated and described without departing from the spirit and scope.

What is claimed is:

1. A pressurized container package, comprising:

(a) a bottle having a neck portion;

(b) a quantity of granular material disposed in and spaced from the top of said bottle;

(c) a stopper disposed in the neck portion of said bottle and space relationed to the top of said granular material; and (d) a valve disposed in the neck portion of said bottle in the space defined between the bottom of the stopper and the upper level of the granular material whereby said valve prevents the expulsion of said granular material when the stopper is removed from the pressurized bottle.

2. The invention defined in claim 1 wherein said valve comprises an accordion pleated element folded in alternating folds.

3. The invention defined in claim 2 wherein said accordion pleated valve element is formed of bond paper and folded to be compressed and expanded in a range of approximately 3/16 inch to 2 inches.

* * * * *